United States Patent [19]

Orr

[11] 4,273,408

[45] Jun. 16, 1981

[54] TERMINAL BLOCK ASSEMBLY

[75] Inventor: Wallace H. Orr, Hendersonville, N.C.

[73] Assignee: General Electric Company, Schenectady, N.Y.

[21] Appl. No.: 13,036

[22] Filed: Feb. 21, 1979

[51] Int. Cl.[3] ..... H01R 9/00

[52] U.S. Cl. ..... 339/198 G; 339/217 S

[58] Field of Search ..... 339/198, 217 S, 221 R, 339/221 M, 132 R, 263 R

[56] References Cited

U.S. PATENT DOCUMENTS

| | | | |
|---|---|---|---|
| 3,056,103 | 9/1962 | Kulka | 339/198 |
| 3,825,880 | 7/1979 | Battaglia et al. | 339/59 R |

FOREIGN PATENT DOCUMENTS

| | | | |
|---|---|---|---|
| 1067909 | 10/1959 | Fed. Rep. of Germany | 339/217 S |
| 1568621 | 5/1969 | France | 339/217 S |
| 747630 | 4/1956 | United Kingdom | 339/198 H |
| 1224538 | 3/1971 | United Kingdom | 339/198 J |

*Primary Examiner*—Eugene F. Desmond

*Attorney, Agent, or Firm*—Lawrence R. Kempton

[57] ABSTRACT

Electrical connector device comprises a conductive terminal strip frictionally held in an insulating terminal block and a screw with captive washer adjustably secured to the terminal strip for holding a wire lead in contact with the terminal strip. The terminal strip is slidable into assembly with the terminal block, and stop means are provided on the screw or terminal strip to prevent removal of the strip from the terminal block.

1 Claim, 4 Drawing Figures

TERMINAL BLOCK ASSEMBLY

The present invention relates to electrical connector devices, and more particularly relates to a terminal block assembly.

It is an object of the invention to provide an improved terminal block assembly having a conductive terminal member readily assembled with and firmly secured to an insulating terminal block.

Another object of the invention is to provide a terminal assembly of the above type wherein the conductive terminal member is securely attached to the terminal block without the use of screws, rivets or similar fastening means.

Still another object of the invention is to provide a terminal block assembly of the above type having no conductive parts on its underside.

A further object of the invention is to provide a terminal assembly of the above type wherein ready separation of the conductive terminal member from the terminal block is prevented.

An additional object of the invention is to provide a terminal assembly of the above type wherein wire leads may be readily securely fastened to the conductive terminal member.

Other objects and advantages will become apparent from the following description and the appended claims.

With the above objects in view the present invention in one of its aspects relates to an electrical connector device comprising, in combination, an insulating terminal block having a bottom and spaced opposite walls defining a passage, the block having a base portion on the bottom thereof extending between the walls in the passage, the base portion having an upper surface, the walls each having ledge means projecting into the passage and extending along and spaced above the plane of the upper surface of the base portion, a strip-shaped conductive terminal member having a front portion arranged on the upper surface of the base portion in the passage and having opposite marginal portions engaging the undersides of the ledge means of the opposite walls for frictionally holding the terminal member in assembly with the terminal block, and fastener means engaging the terminal member for securing a conductor lead to the terminal member.

The invention will be better understood from the following description taken in conjunction with the accompanying drawing, in which.

Figure 1:
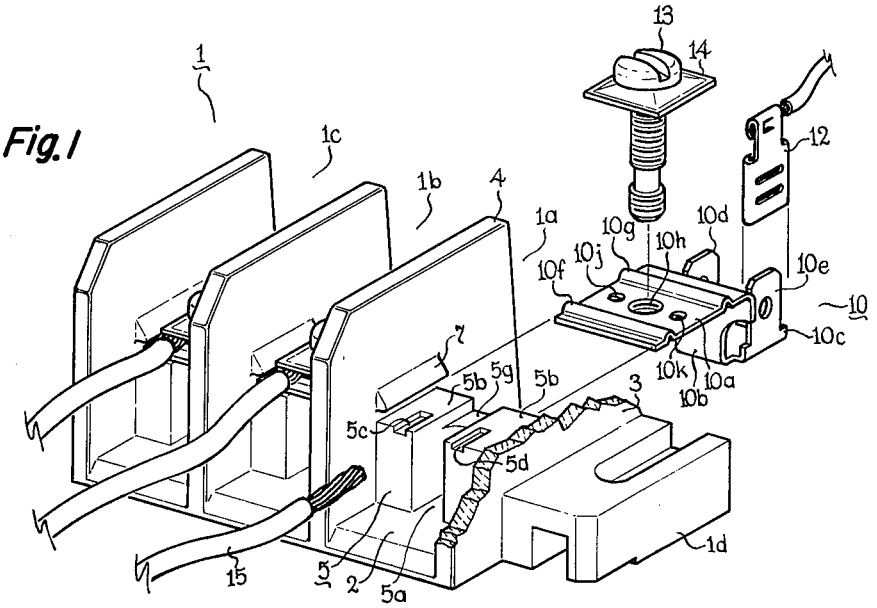
FIG. 1 is an exploded view in perspective of a terminal block assembly in accordance with an embodiment of the invention.

Referring now to the drawing, and particularly to FIG. 1, there is shown terminal block 1 composed of a relatively rigid electrically insulating material such as a synthetic resin and formed with a plurality of terminal sections 1*a, b, c,* each having a structure as more fully described below. Terminal block 1 has an integral lug 1*d* at opposite ends by means of which the block may be suitably secured to a supporting surface, such as a luminaire housing (not shown).

Each terminal section is formed with a bottom wall z from which spaced side walls 3, 4 upwardly extend so as to define a terminal compartment or passage therebetween. Formed on bottom wall 2 and extending between the side walls is base 5 which is formed with a recess 5*a* in its front side. Side walls 3, 4 have ledges 6, 7, respectively, extending along and projecting inwardly into the terminal passage a predetermined distance above the lateral margins of upper surface 5*b* of base 5 (see FIG. 3). The forward portions or ribs of upper base surface 5*b* on each side of recess 5*a* are formed with grooves 5*c, 5d,* as seen in FIGS. 1 and 3, the rearward end of each groove being closed by a stop surface 5*e* (see FIG. 2).

Fitting into each terminal section is a conductive terminal strip 10 made, for example, of brass having a front plate portion 10*a,* an intermediate portion 10*b* extending downwardly at right angles from the front portion, and a rear portion 10*c* having a pair of spaced upstanding terminal tabs or ears 10*d, e* adapted to be connected to one or more external connectors 12 of push-on type.

Front plate portion 10*a* of the terminal strip is formed with spaced transversely extending ridges 10*f, g* and is arranged in the assembly resting on the upper surface of base 5 in the passage between side walls 3 and 4. The width of plate portion 10*a* is slightly less than the spacing between side walls 3, 4 and the height of ridges 10*f, g* is such that when plate portion 10*a* is slid forwardly into the space between ledges 6, 7 and upper surface 5*b* of base 5, the ridges frictionally engage the underside of ledges 6, 7, as seen in FIG. 3.

Figure 3:
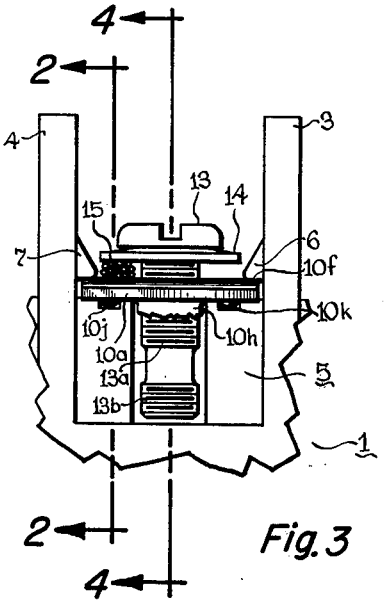
FIG. 3 is an end elevational view of a portion of the terminal block assembly.

Screw 13 threadably engages aperture 10*h* punched out centrally in terminal plate portion 10*a,* and with intervening captive washer 14 serves to clamp lead wire 15 to terminal plate portion 10*a,* as seen in FIG. 3.

Figure 2:
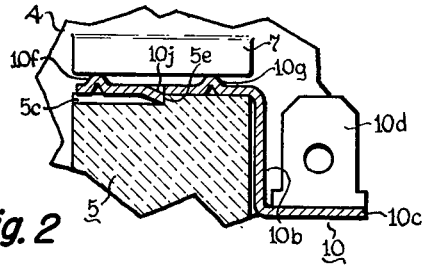
FIG. 2 is a fragmentary side view, partly in section, of a portion of the FIG. 1 assembly, as viewed along the line 2—2 of FIG. 3.

In the illustrated embodiment, terminal plate portion 10*a* has punched-out detents 10*j, k* which project from the underside thereof on opposite sides of aperture 10*h* and are arranged so as to snap into the respective grooves 5*c, 5d* when terminal strip 10 is slid into assembly with terminal block 5. The arrangement is such that when the parts are in assembled condition, as shown in FIG. 2, the detents 10*j, 10k* abut stop surfaces 5*e* at the rear end of grooves 5*c, 5d,* thus preventing rearward withdrawal of terminal strip 10. Forward movement of terminal strip 10 is prevented by abutment of intermediate strip portion 10*b* with the rear side of base 5, as seen in FIG. 2. Terminal strip 10 is thus held in secure assembly with terminal block 2 without the use of screws, rivets or similar fastening devices, and is readily placed in such assembly simply by sliding it between ledges 6, 7 and base 5 until detents 10*j, 10k* snap into grooves 5*c, 5d* as previously described.

Figure 4:
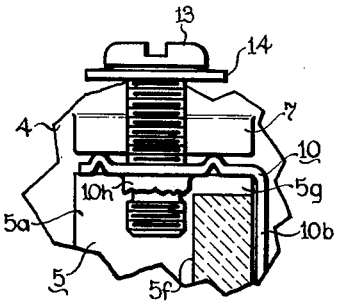
FIG. 4 is a sectional view of a portion of the terminal block assembly taken along the line 4—4 of FIG. 3, showing the wire-clamping screw in retracted position.

Alternative means for preventing rearward withdrawal of terminal strip 10 from base 5 is provided by screw 13 as illustrated in FIG. 4. As shown, screw 13 has upper threaded portion 13*a* and lower threaded portion 13*b* spaced from each other. In assembling the parts, screw 13 is screwed through threaded punched-out portion 10*h* of strip 10 to the position shown in FIG. 3 in which it tightly clamps wire lead 15 to terminal plate 10*a.* In both this position and the partially retracted position shown in FIG. 4, screw 13 extends at least partially into recess 5*a,* and accordingly prevents rearward withdrawal of terminal strip 10 by abutting stop surface 5*f* of base 5 at the rearward end of recess 5*a*. The upper end of lower screw portion 13*b* is preferably upset to prevent complete removal of screw 13 to thereby ensure operation of such a stop means.

The upper surface of base 5 rearward of recess 5*a* in the illustrated embodiment is formed with a shallow recess 5*g* (see FIG. 4) to accommodate passage of punched-out portion 10*h* of terminal plate portion 10*a* when the latter is slid into assembled position on base 5.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. Electrical connector device comprising, in combination, an insulating terminal block having a bottom and spaced opposite walls defining a passage, said block having a base portion on the bottom thereof extending between said walls in said passage, said base portion having an upper surface, said walls each having ledge means projecting into said passage and extending along and spaced above the plane of said upper surface of said base portion, a strip-shaped conductive terminal member having a front portion arranged on said upper surface of said base portion in said passage and having opposite marginal portions engaging the undersides of said ledge means of said opposite walls for frictionally holding said terminal member in assembly with said terminal block, and fastener means engaging said terminal member for securing a conductor lead to said terminal member, said terminal member being slidable along said plane with its front portion between said ledge means and the upper surface of said base portion into assembled position on said terminal block, said fastener means comprising a screw passing through and threadably engaging the front portion of said terminal member, said base portion formed with a recess in which said screw is received, said screw coacting with a wall of said recess for preventing withdrawal of said terminal member from said terminal block, said base portion having a rear surface transverse said upper surface, said terminal member having an intermediate portion rearward of and extending downwardly below the plane of said front portion and arranged closely adjacent said rear surface of said base portion in said assembled position for preventing substantial forward movement of said terminal member relative to said terminal block in said position.

* * * * *